US010611452B1

(12) United States Patent
LaGrasso

(10) Patent No.: US 10,611,452 B1
(45) Date of Patent: Apr. 7, 2020

(54) OUTDRIVE FLEXIBLE SHIELD APPARATUS

(71) Applicant: Bonnie LaGrasso, San Clemente, CA (US)

(72) Inventor: Bonnie LaGrasso, San Clemente, CA (US)

( * ) Notice: Subject to any disclaimer, the term of this patent is extended or adjusted under 35 U.S.C. 154(b) by 0 days.

(21) Appl. No.: 15/483,582

(22) Filed: Apr. 10, 2017

(51) Int. Cl.
*B63H 21/36* (2006.01)
*B63B 59/04* (2006.01)
*B63B 21/04* (2006.01)

(52) U.S. Cl.
CPC ..... *B63H 21/36* (2013.01); *B63B 21/045* (2013.01); *B63B 59/04* (2013.01); *B63B 59/045* (2013.01)

(58) Field of Classification Search
CPC ..... B63B 59/00; B63B 59/04; B63B 59/045; B63B 59/06; B63B 2059/065; B63B 59/08; B63B 2059/082; B63B 2059/085; B63B 2059/087; B63B 59/10; B63H 20/36; B63H 21/36
USPC ..... 114/222; 440/113; 150/157; 416/247 A
See application file for complete search history.

(56) References Cited

U.S. PATENT DOCUMENTS 3,220,374 A * 11/1965 Sloan ..... B63B 59/045 114/222
3,587,508 A 6/1971 Pearce
3,870,875 A 3/1975 Altimus
3,886,889 A * 6/1975 Burger ..... B63B 59/08 114/222
4,869,695 A * 9/1989 Sajdak, Jr. ..... B63H 20/36 114/222
4,998,496 A 3/1991 Shaw, III
5,148,777 A * 9/1992 Brockhurst ..... B63H 20/36 123/198 E
5,315,949 A * 5/1994 Bradley ..... B63B 59/045 114/222
5,964,174 A * 10/1999 Coggan ..... B63H 5/165 114/222

* cited by examiner

*Primary Examiner* — Ajay Vasudeva

(57) ABSTRACT

An outdrive flexible shield apparatus has a rectangular frame and a rectangular flexible liner. The frame has a front pole, a left back corner, and a right back corner. The front pole of the rectangular frame has a left segment and a right segment, the right segment separated by a gap from the left segment. A circular opening is medially disposed within a front surface of the rectangular flexible liner. The rectangular flexible liner is attachable to the frame. A left rope attaches the back left corner of the apparatus to a boat and another right rope attaches the back right corner of the apparatus to the boat. A dissolvable chlorine cartridge is removably disposable within the cavity of the substantially rectangular flexible liner.

3 Claims, 5 Drawing Sheets

OUTDRIVE FLEXIBLE SHIELD APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

TO ALL WHOM IT MAY CONCERN

Be it known that I, Bonnie LaGrasso, a citizen of the United States, have invented new and useful improvements in an outdrive protective apparatus as described in this specification.

BACKGROUND OF THE INVENTION

Various types of outdrive protective apparatuses are known in the prior art. However, what has been needed is an outdrive flexible shield apparatus including a rectangular frame and a substantially rectangular flexible liner. The flexible liner has a top area and a front surface, and an opening medially disposed within the front surface. What has been needed further is for a perimeter of the rectangular frame to equal a perimeter of the top area of the flexible liner, and for the top area of the liner to be attachable to the rectangular frame. Lastly, what has been needed is for each of a left rope and a right rope to attach the outdrive flexible shield apparatus to a motorized water craft. The outdrive flexible shield apparatus thus helps to protect an outdrive motor from marine growth and electrolysis.

FIELD OF THE INVENTION

The present invention relates to outdrive protective apparatuses, and more particularly, to an outdrive flexible shield apparatus.

SUMMARY OF THE INVENTION

The general purpose of the outdrive flexible shield apparatus, described subsequently in greater detail, is to provide an outdrive flexible shield apparatus that has many novel features that result in an outdrive flexible shield apparatus that is not anticipated, rendered obvious, suggested, or even implied by prior art, either alone or in combination thereof.

To accomplish this, the outdrive flexible shield apparatus includes a rectangular frame having a front pole, a back pole, a left pole, a right pole, a left back corner, and a right back corner. The front pole of the rectangular frame has a left segment and a right segment. A gap separates each of the left segment and the right segment of the front pole of the rectangular frame. Furthermore, the outdrive flexible shield apparatus includes a substantially rectangular flexible liner with a front surface, a back surface, a left surface, a right surface, a bottom surface, an open cavity, and an open top side. Each of the front surface, the center front surface, the back surface, the left surface, and the right surface has a top area. A circular opening is medially disposed within the front surface of the substantially rectangular flexible liner, and the circular opening is of a diameter to surround the rear drive assembly of a water craft. A perimeter of the rectangular frame is equal to a perimeter of the top area of the liner, and the top area of the liner is attachable to the rectangular frame.

Lastly, the outdrive flexible shield apparatus includes a left side rope and a right side rope. A back end of each rope is attachable to a cleat on the water craft, with the front end of the left side rope disposed on the left back corner of the rectangular frame, and the right side rope disposed on the right back corner of the rectangular frame. Lastly, a dissolvable chlorine cartridge is removably disposable within the cavity of the substantially rectangular flexible liner. The rectangular frame is optionally PVC piping, and the rectangular liner is optionally rubber-vinyl for added durability and strength. Thus has been broadly outlined the more important features of the outdrive flexible shield apparatus so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
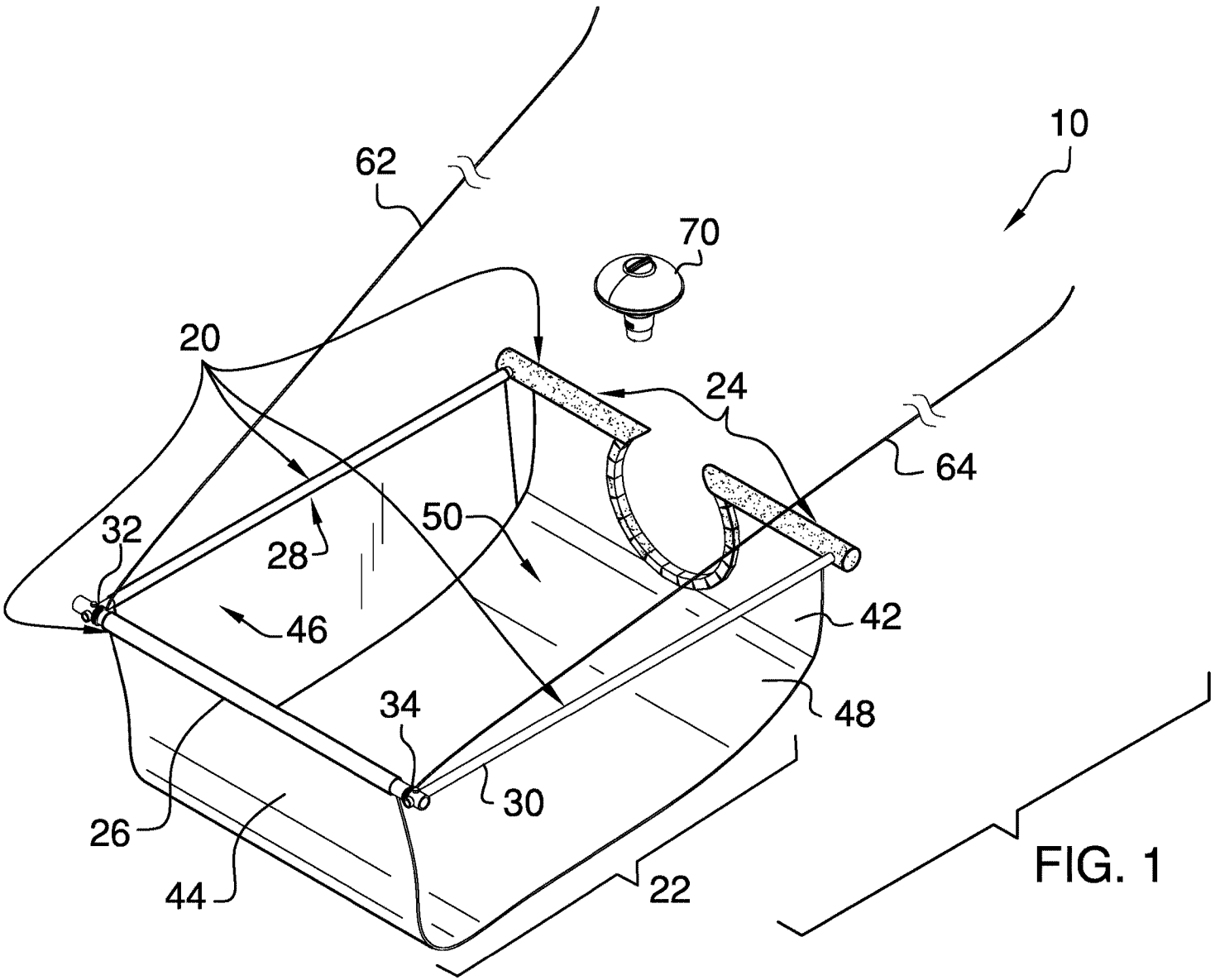
FIG. 1 is a rear isometric view.
Figure 2:
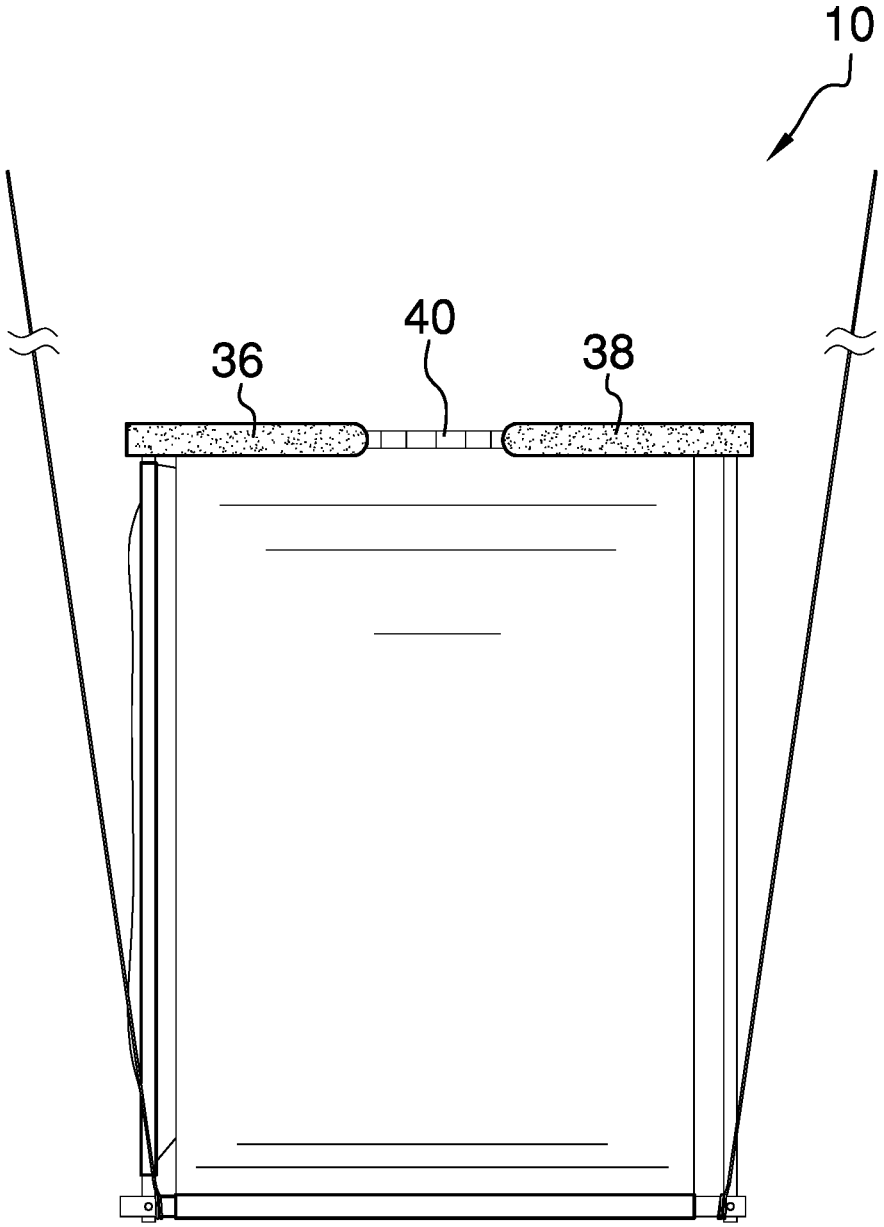
FIG. 2 is a top plan view.
Figure 3:
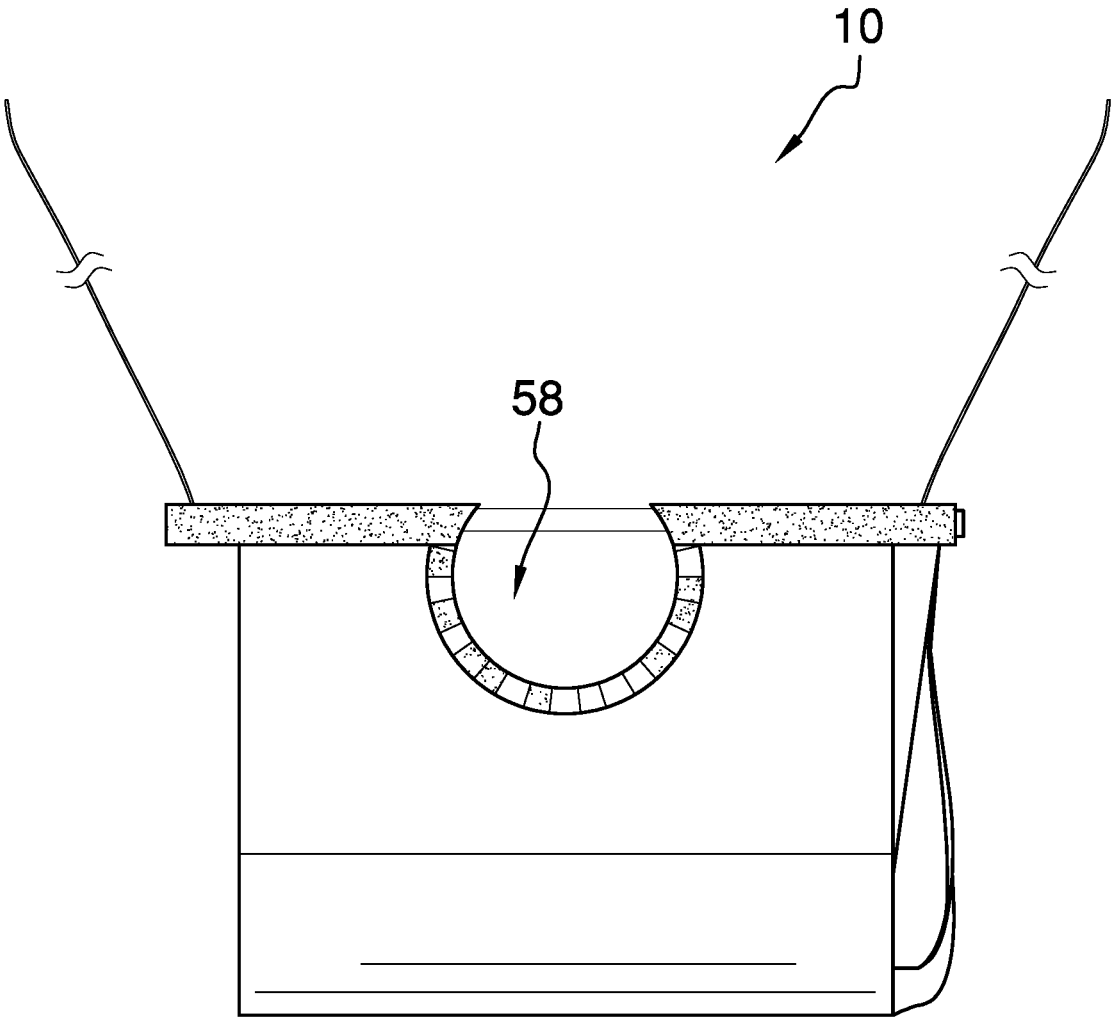
FIG. 3 is a front elevation view.
Figure 4:
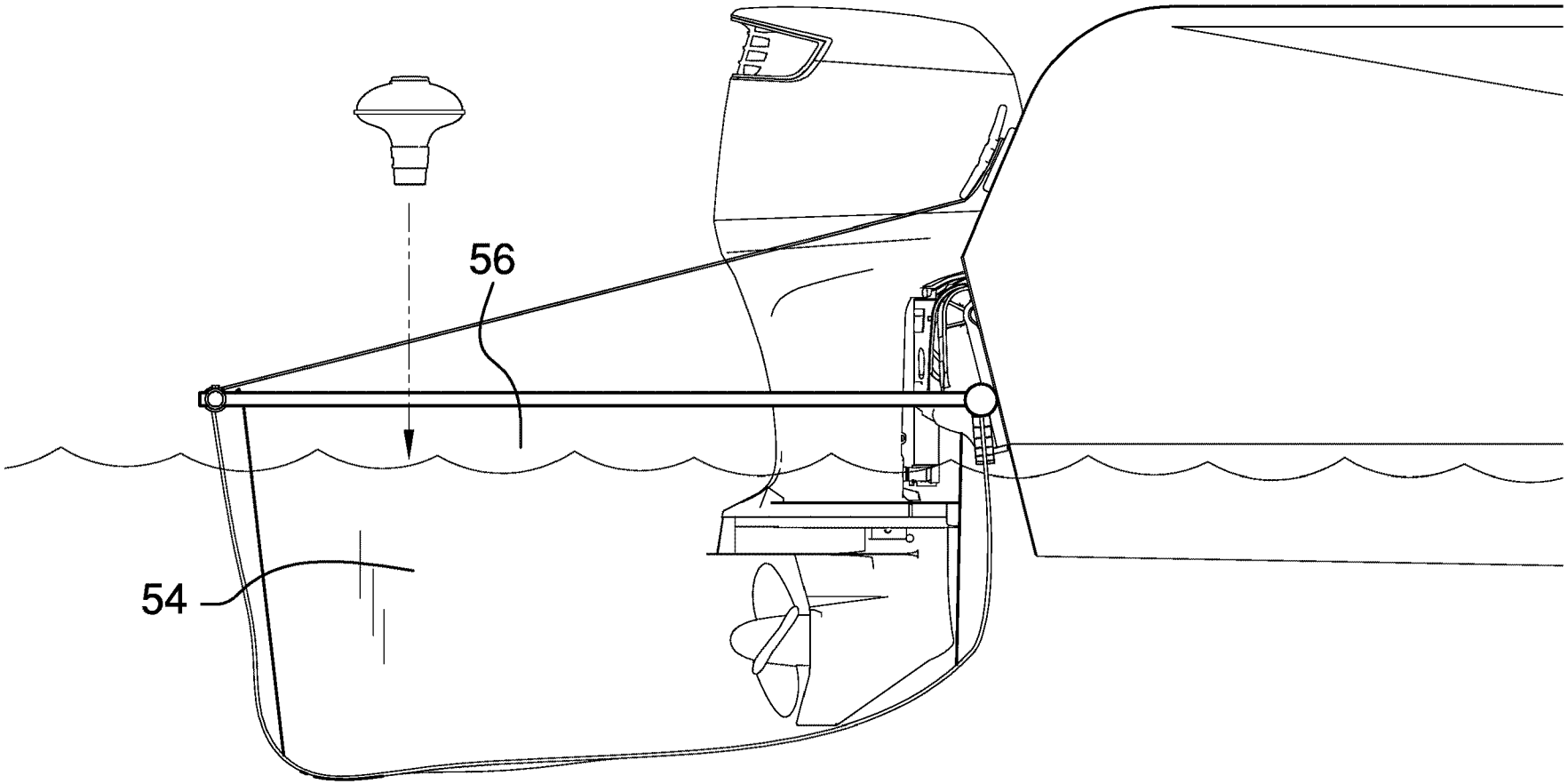
FIG. 4 is a side elevation view.
Figure 5:
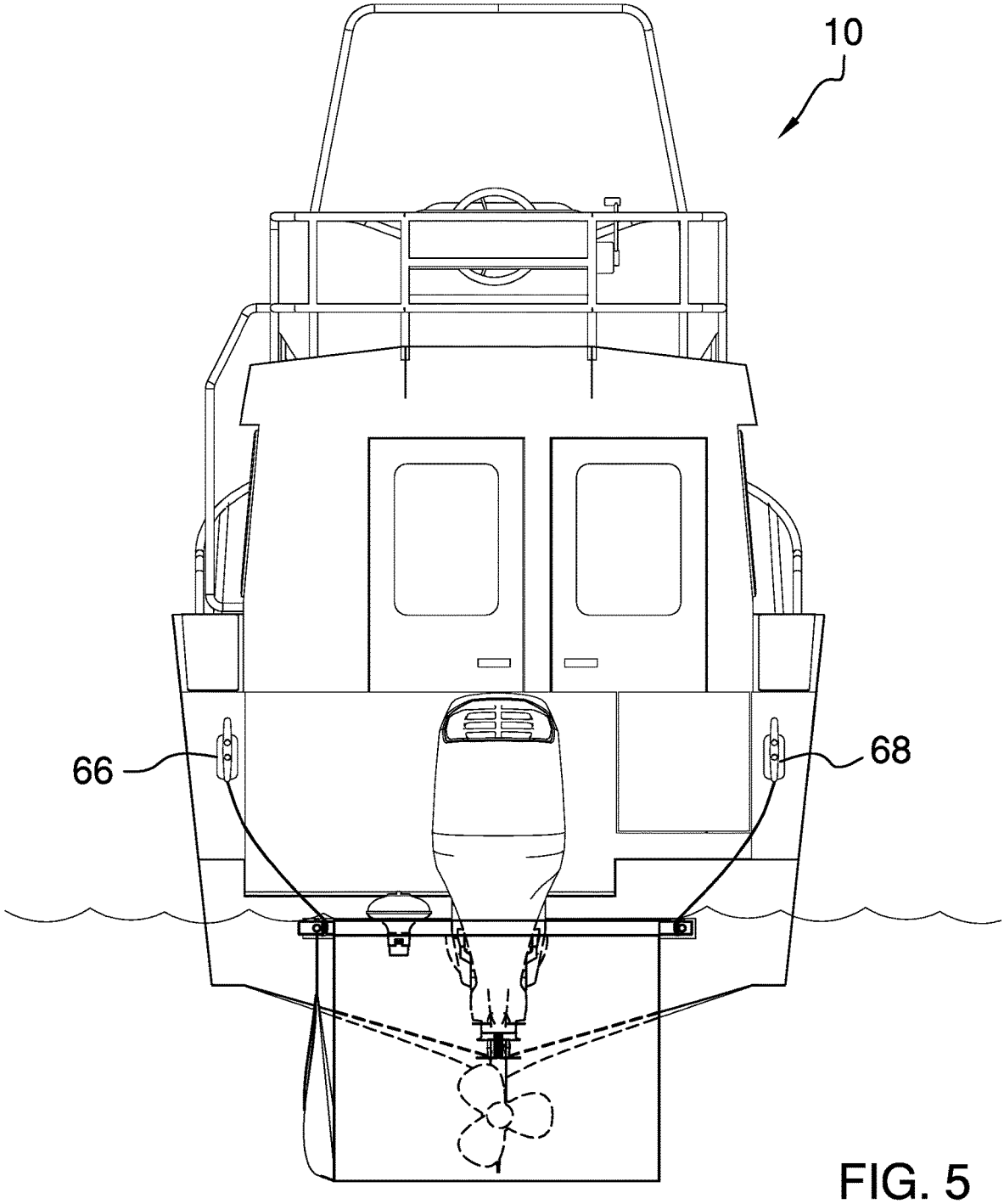
FIG. 5 is a rear elevation view.

With reference now to the drawings, and in particular FIGS. 1 through 5 thereof, an example of the outdrive flexible shield apparatus employing the principles and concepts of the present outdrive flexible shield apparatus and generally designated by the reference number 10 will be described.

Referring to FIGS. 1 through 5 the present outdrive flexible shield apparatus 10 is illustrated. The outdrive flexible shield apparatus 10 includes a rectangular frame 20 and a substantially rectangular flexible liner 22. The rectangular frame 20 has a front pole 24, a back pole 26, a left pole 28, a right pole 30, a left back corner 32, and a right back corner 34. The front pole 24 of the rectangular frame 20 has a left segment 36, a right segment 38, and an open gap 40 disposed between the left segment 36 and right segment 38.

The flexible liner 22 has a front surface 42, a back surface 44, a left surface 46, a right surface 48, a bottom surface 50, an open cavity 52, and an open top side 54. Each of the front surface 42 of the flexible liner 22, the back surface 44 of the flexible liner 22, the left surface 46 of the flexible liner 22, and the right surface 48 of the liner 22 has a top area 56. A circular opening 58 is medially disposed within the front surface 42 of the substantially rectangular flexible liner 22. A diameter of the circular opening 58 is disposable around the rear drive assembly of a water craft.

A perimeter of the rectangular frame 20 equals a perimeter of the top area 60 of the flexible liner 22. The top area of the liner 22 is attachable to the rectangular frame 20.

The outdrive flexible shield apparatus 10 further includes a left rope 62 attachable to the left back corner 32 of the rectangular frame 20 and a right rope 64 attachable to the right back corner 34 of the rectangular frame 20. The left rope 62 is attachable to a cleat 66 on a left side of a boat, and the right rope 64 is attachable to a cleat 68 on a right side of the boat. Lastly, a dissolvable chlorine cartridge 70 is removably disposable within the open cavity 54 of the liner 22.

What is claimed is:

1. An outdrive flexible shield apparatus comprising:

a rectangular frame having a left front pole, a right front pole, a back pole, a left pole, a right pole, a left back corner, and a right back corner;

a gap disposed between the left front pole and the right front pole;

a substantially rectangular flexible liner having a front surface, a back surface, a left surface, a right surface, a bottom surface, an open cavity, and an open top side, wherein each of the front surface, the back surface, the left surface, and the right surface has a top area;

a circular opening medially disposed within the front surface of the substantially rectangular flexible liner, wherein the circular opening is disposable around a rear drive assembly of a boat;

wherein a perimeter of the rectangular frame equals a perimeter of the top area of the substantially rectangular flexible liner;

wherein the perimeter of the top area of the substantially rectangular flexible liner is attachable to the perimeter of the rectangular frame;

a pair of ropes comprising a left side rope and a right side rope, each of the left side rope and the right side rope having a front end and a back end;

wherein the front end of the left side rope is disposed on the left back corner of the rectangular frame, and the back end of the left side rope is attachable to a cleat on a left side of the boat;

wherein the front end of the right side rope is disposed on the right back corner of the rectangular frame, and the back end of the rope is attachable to a cleat on a right side of the boat; and a dissolvable chlorine cartridge removably disposable within the cavity of the substantially rectangular flexible liner.

2. The outdrive flexible shield apparatus of claim 1 wherein the rectangular frame is a PVC piping.

3. The outdrive flexible shield apparatus of claim 1 wherein the substantially rectangular liner is rubber-vinyl.

* * * * *